United States Patent [19]

Spalding et al.

[11] Patent Number: 4,723,876

[45] Date of Patent: Feb. 9, 1988

[54] METHOD AND APPARATUS FOR PILED FOUNDATION IMPROVEMENT WITH FREEZING USING DOWN-HOLE REFRIGERATION UNITS

[75] Inventors: August V. Spalding, Pinole; Richard C. Lundberg, Larkspur; Ronald O. Hamburger, Pacifica; Mahmoud H. Sabet, Hayward; Gerald F. Borrmann, Lafayette, all of Calif.

[73] Assignee: Chevron Research Company, San Francisco, Calif.

[21] Appl. No.: 833,293

[22] Filed: Feb. 25, 1986

[51] Int. Cl.[4] ..... E02D 5/46

[52] U.S. Cl. ..... 405/225; 405/227; 405/224; 405/130; 62/259.1

[58] Field of Search ..... 405/130, 217, 224, 225, 405/234; 62/259.1, 260; 165/45

[56] References Cited

U.S. PATENT DOCUMENTS

| | | | |
|---|---|---|---|
| 3,435,629 | 4/1969 | Hallenburg | 62/259.1 |
| 3,472,314 | 10/1969 | Balch | 62/260 |
| 3,798,912 | 3/1974 | Best et al. | 62/260 |
| 3,874,181 | 4/1975 | Pogonowski | 61/63 |
| 3,985,182 | 10/1976 | Hara et al. | 62/259.1 |
| 3,995,438 | 12/1976 | Pognowski | 465/244 |
| 4,055,052 | 10/1977 | Metge | 62/260 |
| 4,111,258 | 9/1978 | Jahns et al. | 165/40 |
| 4,257,720 | 3/1981 | Ostgaard | 405/224 |
| 4,286,898 | 9/1981 | Stafford | 405/224 |
| 4,322,181 | 3/1982 | Streich et al. | 405/224 |
| 4,577,679 | 3/1986 | Hibshman | 165/45 |
| 4,626,136 | 12/1986 | Gunderson | 405/224 |

FOREIGN PATENT DOCUMENTS

| | | | |
|---|---|---|---|
| 3335511 | 4/1985 | Fed. Rep. of Germany | 405/234 |
| WO85/01762 | 4/1985 | PCT Int'l Appl. | 405/224 |
| 617521 | 7/1978 | U.S.S.R. | 405/234 |

OTHER PUBLICATIONS

Parameswaran, "Adfreeze Strength of Model Piles in Ice", Can. Geotech. J., vol. 18, pp. 8116 (1981).

Ogata et al, "Effects of Salt Concentration on Strength and Creep Behavior of Artificially Frozen Soils, Cold Region Science & Technology, vol. 8, pp. 139–153 (1983).

Shuster, "Controlled Freezing for Temporary Ground Support", North American Rapid Excavation and Tunneling Conference, vol. 2, pp. 863 (1972).

*Primary Examiner*—Randolph A. Reese
*Assistant Examiner*—Anthony Knight
*Attorney, Agent, or Firm*—S. R. LaPaglia; E. J. Keeling; V. A. Norviel

[57] ABSTRACT

The invention relates to a method and apparatus for increasing the capacity of a tubular driven pile. A refrigeration unit is lowered into the pile and grouted in place above a cement plug. The area between the refrigeration unit and the plug is filled with a secondary refrigerant. Seawater fills the pile above the refrigeration unit and is used for refrigeration unit cooling. The refrigeration unit cools the brine until the soil surrounding the pile is frozen. The adfreeze strength of the frozen soil and the pile increase the pull-out resistance of the pile. Further, the end-bearing capacity of the pile is increased as a result of the large frozen mass surrounding the pile.

10 Claims, 8 Drawing Figures

METHOD AND APPARATUS FOR PILED FOUNDATION IMPROVEMENT WITH FREEZING USING DOWN-HOLE REFRIGERATION UNITS

This application is related to U.S. Ser. No. 833,292.

BACKGROUND OF THE INVENTION

Frequently, large structures, such as offshore platforms, are anchored to the earth with tubular piles. Those piles are inserted through structural members of the platform and driven into the earth. They are then attached or "grouted" to the structural member. Often, these piles extend several hundred feet into the earth.

The length, number, and size of the pilings are in large part determined by the type of soil through which the piles are driven. Characteristics of the soil are normally determined before fabrication of the structure by analysis of soil samples or by other means. Unfortunately, in some cases, the soil characteristics are inaccurately predicted and it is found that the as-driven piles provide inadequate support for the structure after the structure is installed.

On other occasions, the soil qualities can be accurately determined, but it may be desirable to enhance the load capability of the piling. In still other cases, the structure is installed in permafrost and the frozen condition of the soil must be maintained to prevent settling of the structure.

Various methods of increasing or maintaining the load-bearing capacity of piles have been developed. For example, "anchor bumps" can be created on the pile to increase the load-bearing capacity and pull out resistance of the pile (U.S. Pat. No. 3,995,438). In some cases this may, however, not sufficiently increase the capacity of the pile.

Methods of maintaining the frozen condition of the soil have also been described (French Patent No. 475,226, see also U.S. Pat. No. 4,111,258). These methods rely on the circulation of cold ambient air through the pile to maintain the frozen condition of the soil. Such methods could not be applied in an area where extremely cold ambient conditions do not exist for a substantial portion of the year. Further, they provide only for the maintenance of the soil in the frozen condition to prevent subsidence and do not provide increased pull-out capacity.

Ground freezing has been used in order to provide temporary structural support while installing a subterranean tunnel, to prevent settling of a runway set on permafrost, and to prevent water encroachment during the installation of a ventilation shaft (Braun, B., and Nash, W. R., "Ground Freezing for Construction", *Civil Engineering*, January, 1985, pp. 54-56). In none of the above situations is a permanent method of substantially increasing the loadbearing and pull-out capacity of a tubular pile provided.

In summary, it is clear that an improved method of substantially enhancing the load-bearing and pull-out capacity of a pile is desirable.

BRIEF DESCRIPTION OF THE PREFERRED EMBODIMENT

The present invention provides a means and method for increasing the capacity of tubular piles by freezing one or more areas of soil surrounding the piles. The invention would be used where a tubular pile, whose design capacity was to be provided through shaft friction, is incapable of supporting design loads because adequate shaft friction cannot be developed, or where the frozen condition of soil surrounding the pile must be maintained to prevent settling.

The preferred embodiment features a sealed, cone-shaped refrigeration unit which is lowered into the pile of an offshore platform. Below the refrigeration unit, the pile is filled with a brine solution (such as calcium chloride), the bottom of the pile being sealed with a concrete plug. Seawater fills the pile above the refrigeration unit and is allowed to commingle with seawater above the mud-line. The refrigeration unit forms a tight seal in the pile to prevent commingling of the seawater above the unit and the brine below the unit and serves as a thermal barrier between the seawater and the brine.

The refrigeration unit consists of from 1 to 3 motor-driven refrigeration compressors of the type commonly known to one skilled in the art. In the preferred embodiment, 3 compressors each having a capacity of from 10 to 20 horsepower are installed in each refrigeration unit. This would be sufficient to cool the brine to approximately −20° to −30° C.

The condenser for the refrigeration unit protrudes into the seawater above the refrigeration unit and the seawater provides condensor cooling. Seawater circulates within the pile by natural convection.

The refrigeration evaporator and expansion tank extend into and cool the brine solution. In turn, the brine cools and eventually freezes the in-situ pore water surrounding the pile and eventually the adjacent soil sediments thus forming a large frozen soil mass.

The net result is that the pile has greatly increased capacity against downward and pull-out load applications. The major components contributing to this increased capacity are the increased side friction and end bearing between the frozen and unfrozen soil masses, both being transferred through the indirect adfreeze bond between the steel pile and surrounding soil.

OBJECTS OF THE INVENTION

It is the particular object of the invention to provide a method of increasing or maintaining the load bearing capacity of a tubular pile by freezing and/or maintaining the frozen condition of soil in an area surrounding the pile. It is a further object of the invention to provide the apparatus and by which the soil surrounding a pile can be frozen and/or maintained in a frozen condition. It is a further object of the invention to provide the method and apparatus for installing and maintaining a down-pile, pile shaft freezing apparatus. Additional objects and advantages of the present invention will become apparent from reading the following detailed description in view of the accompanying drawings which are made part of this specification.

DETAILED DESCRIPTION OF THE PREFERRED EMBODIMENT

Figure 1:
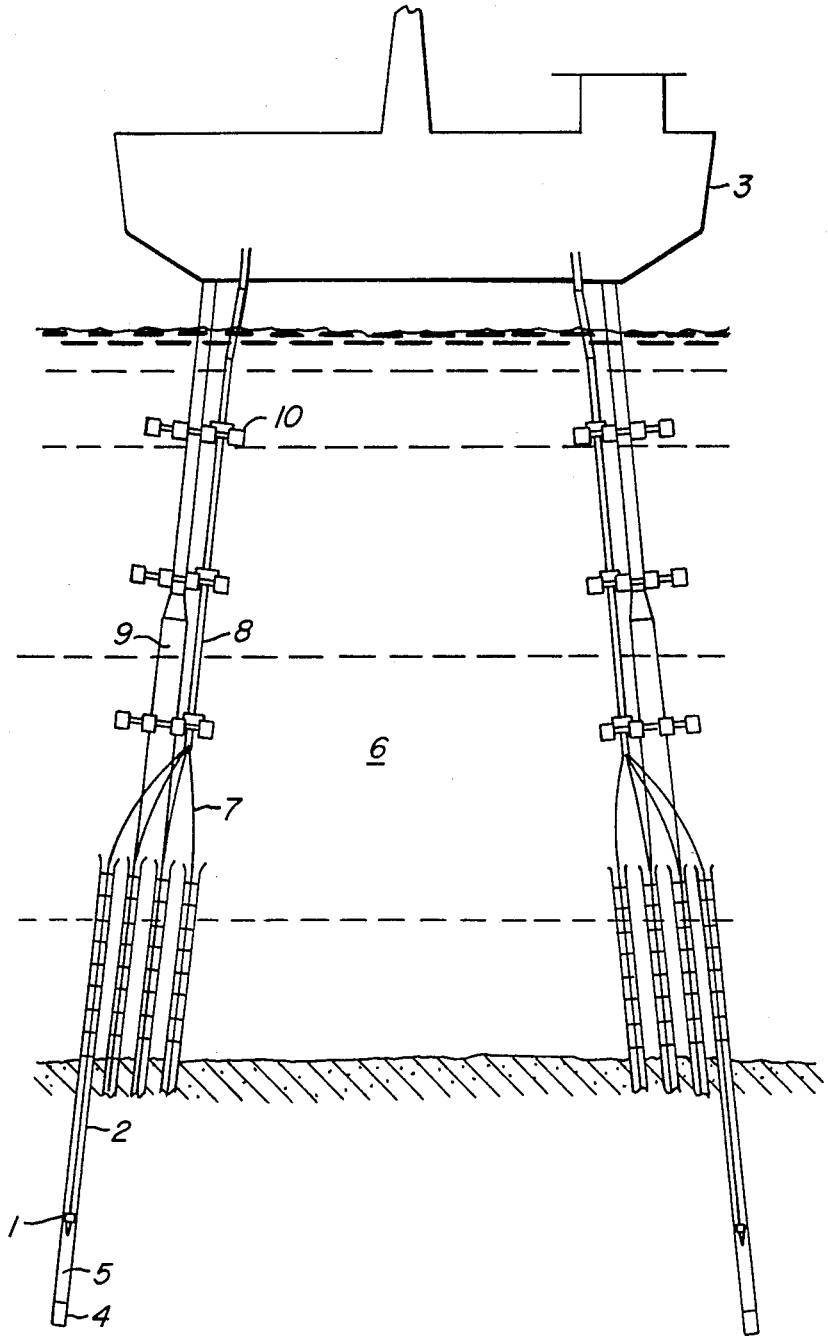
FIG. 1 depicts an offshore platform with a detailed cross section of two piles into which a refrigeration unit has been installed.

FIG. 1 generally illustrates the concept of down-pile foundation pile shaft freezing in the preferred embodiment. In this embodiment, sealed refrigeration units 1 are placed inside the tubular pilings 2 of an offshore platform 3 a predetermined distance above a bottom brine seal, which is a concrete plug 4 in the preferred embodiment.

The area between the refrigeration unit 1 and the cement plug 4 is filled with $CaCl_2$ or a similar secondary refrigerant 5 which has a freezing point sufficiently lower than the water contained within the soil surrounding the pile. Although $CaCl_2$ is described in the preferred embodiment, other secondary refrigerants may be used depending on the design operating temperature which will account for factors such as the necessary adfreeze strength, soil property variations with temperature, and other factors. Various secondary refrigerants are well-known in the art. For example, ethylene glycol, or alcohol/water mixtures might also be used.

Seawater 6 is allowed to freely enter and leave the pile 2 above the refrigeration unit 1. The refrigeration unit 1 forms a tight seal with the pile 2 which prevents commingling of the seawater above the refrigeration unit and the brine below the refrigeration unit and serves to thermally insulate the cold brine and ambient seawater.

Each refrigeration unit 1 is provided with power from the platform 3 from an umbilical 7. The umbilicals from the various piles are routed through a common caisson 8 on each platform leg 9. These caissons are routed through the jacket pile installation guides 10. Instrumentation lines (not shown) are also included in the umbilical lines.

Figure 2:
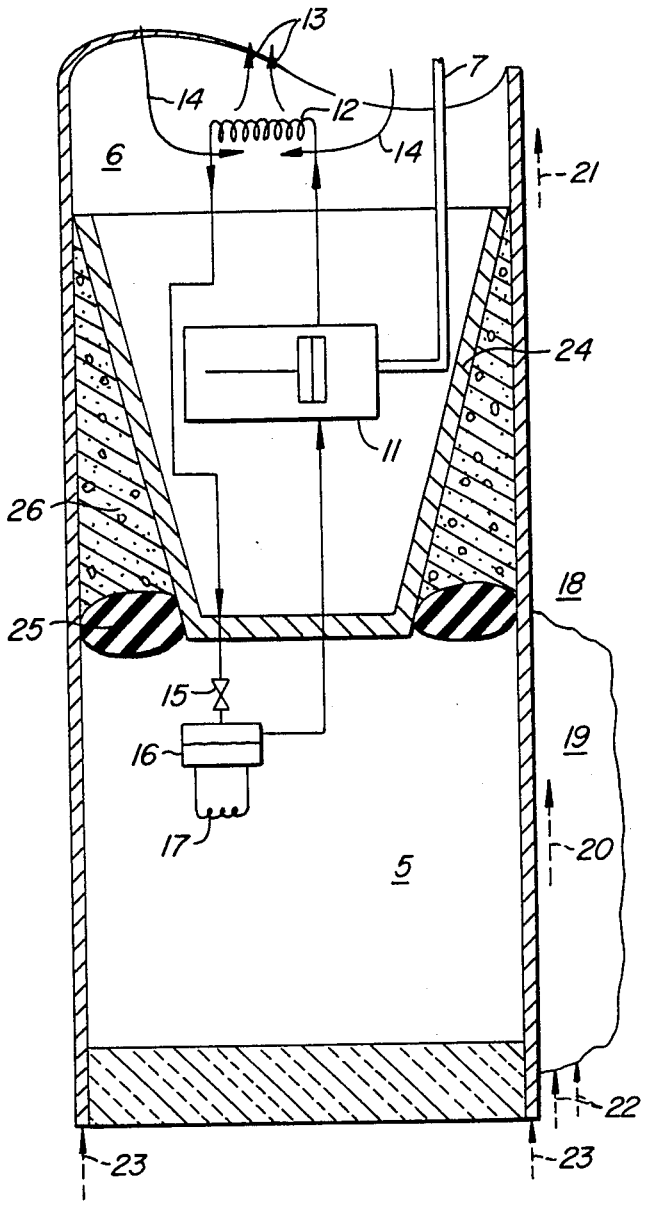
FIG. 2 is a cross section of the refrigeration unit which generally depicts the flow of refrigerant through the system and the circulation of brine and seawater in the pile.

FIG. 2 illustrates generally the operation of the refrigeration unit. Identical pieces of equipment from FIG. 1 are identically numbered.

Refrigerant of a type commonly used in the art (propane in the preferred embodiment) is compressed in the refrigeration compressor 11 and warm, compressed refrigerant flows into a falling film condenser 12 where heat is transferred to the surrounding, cooler seawater 6 and the refrigerant condenses. Refrigerants other than propane are well-known to one skilled in the art and could also be utilized (for example, ammonia).

As the seawater is warmed, it becomes buoyant and rises in the piling [illustrated by arrows 13]. Cooler seawater displaces the warm seawater so that the area surrounding the condenser remains cool [illustrated by arrows 14].

The condensed refrigerant passes through an expansion valve 15 to a low pressure evaporation tank 16 and evaporator 17. As the refrigerant boils, it absorbs energy from the brine in the evaporator and the brine 5 cools. The brine, like the seawater, is circulated by natural convection, i.e., as the brine is cooled it falls and is replaced by warmer brine.

As heat is transferred from the surrounding soil 18 to the brine, the soil cools and the pore water contained within the soil freezes. Eventually, a large frozen mass of soil 19 surrounding the pile is formed. The size of this frozen mass and rate of formation can be determined from thermodynamic calculations familiar to one skilled in the art. Adhesive friction between the tubular pile and the frozen soil [depicted by arrow 20]is significantly greater than shaft friction between a tubular pile and unfrozen soil [depicted by arrow 21]. Provided adfreeze strength between the tubular pile and frozen soil is sufficiently strong to transfer loading, the frozen mass surrounding the pile provides increased support because: (1) Side friction area, with time after initiation of freezing, available to transfer loading into the native unfrozen soil mass is much greater than that available without freezing, thus allowing increased support capability; and (2) End bearing area formed due to the freezing process forms an additional support component (depicted by arrows 22) contributing to increased foundation capacity over that provided by the pile alone (depicted by arrows 23).

Power and instrumentation lines for the refrigeration unit enter the refrigeration unit through the umbilical 7. Insulation 24 is provided around the refrigeration unit to prevent freezing of the seawater from indirect contact with the brine. Packers 25 and grout 26 hold the unit in place.

Figure 3:
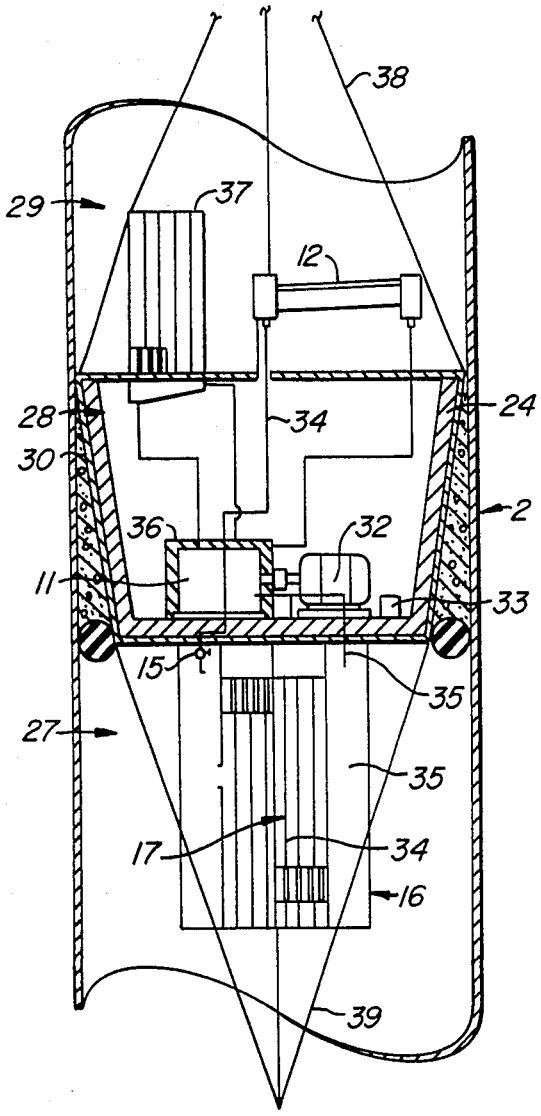
FIG. 3 is a cross section of a refrigeration unit showing details of the internal components of the refrigeration unit.
Figure 4:
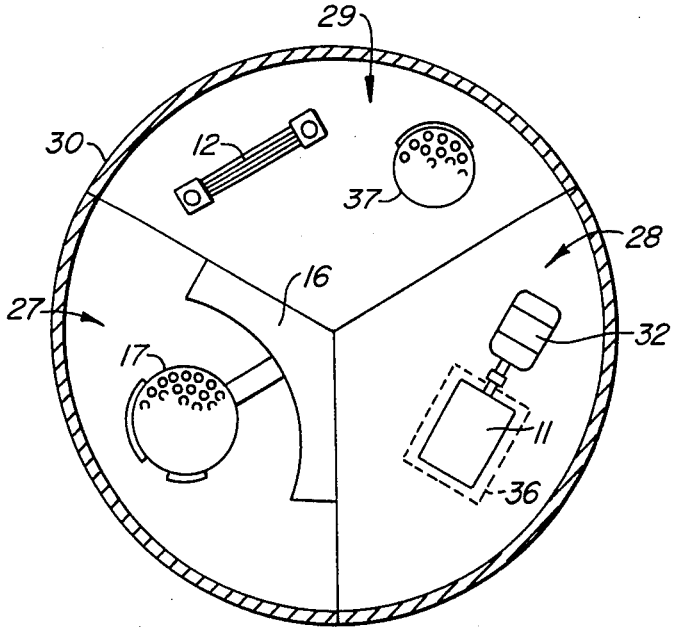
FIG. 4 shows three top plan views of the refrigeration unit at the top level, middle level, and bottom level.

Greater detail regarding the refrigeration units is provided in FIGS. 3 and 4. Again, identical pieces of equipment are identically numbered with FIGS. 1 and 2. FIG. 4 is a cutaway planar view of the refrigeration unit. The far left section 27 is a view beneath the refrigeration unit in the brine bath. The far right section 28 is a view within the refrigeration unit. The top section 29 is a view of the top of the refrigeration unit at the seawater level. It should be noted that one or more refrigeration compressors may be included within a single refrigeration unit. FIG. 4 illustrates the arrangement of equipment that would be appropriate for a refrigeration unit having 3 compressors (a "triplex" system), but the claims are not so limited. The advantage of using 3 compressors are: (1) It provides the high start-up capacity necessary to freeze the soil; and (2) It provides back-up compressors after the soil is frozen because it becomes unnecessary to run all three compressors.

The main body of the refrigeration unit consists of a sealed, tapered, steel vessel 30 which fits within the tubular pile. The vessel contains one or more hermetically sealed compressors 11 driven by electric motors 32. An insulation barrier is provided around the the vessel 24. The vessel is tapered to allow for the flow of fluids around it as it is raised and lowered into the pile. The vessel contains ballast weights 33 which provide neutral buoyancy for the entire package. The vessel is grouted to the pile to hold it in place, but in the event that the unit would need to be removed, the tapered shape would result in less effort to break the grout. The effort required to remove the refrigeration unit from the pile is further reduced by coating the vessel with a bond breaking agent.

An evaporator 17 and refrigerant tank 16 are suspended beneath the vessel for each refrigeration compressor in the unit. The condenser discharge line 34, expansion valve 15 and compressor suction line all protrude through the top of the refrigerant tank. The compressor is provided with protection from liquids which are well known in the art (not shown).

The condenser 12 is mounted on top of the vessel. The compressor is equipped with a cooling water jacket 36 which circulates warm water to a jacket water cooler 37 which is also mounted on top of the vessel and is cooled with seawater contained within the pile.

To provide protection to the exposed portions of the refrigeration unit during installation and maintenance, an upper tripod frame 38 and a lower tripod frame 39, constructed of tubular steel members, are attached to the top and bottom of the vessel, respectively. The upper tripod frame also serves as an attachment point for the drill string used in installation/removal of the unit.

Figure 5:
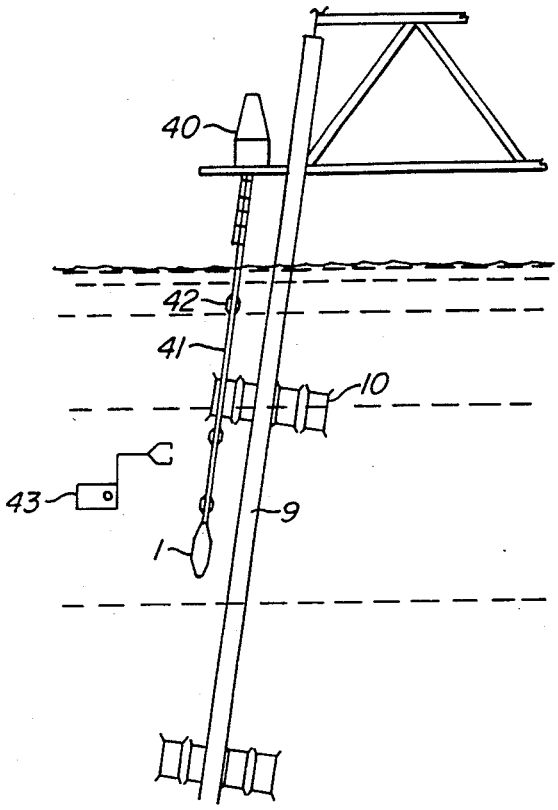
FIG. 5 shows the manner in which the refrigeration unit is lowered into the pile.

Installation of the refrigeration unit is illustrated in FIGS. 5 through 8. Referring first to FIG. 5, pile guides 10 adjacent to the jacket legs 9 are used as guides to lower the refrigeration unit 1 into position. A workover rig 40 or similar structure is used to lower the refrigeration unit into place. A drill string 41 of the type commonly used in oil well drilling operations can be used to suspend the refrigeration unit. Centralizers 42 and a submersible vehicle 43 may also be used to help guide the refrigeration unit into place.

Figure 6:
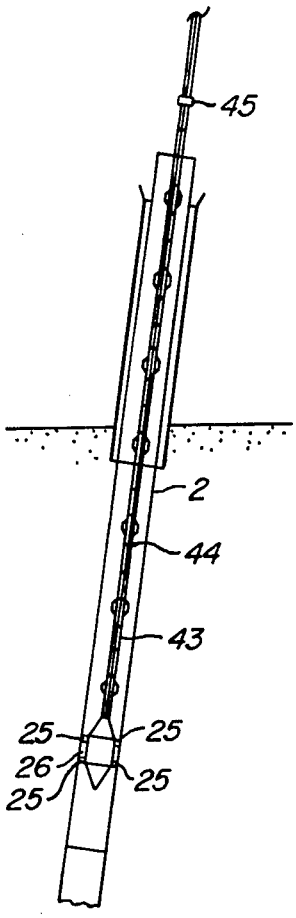
FIG. 6 shows a cross section of the refrigeration unit after being lowered into its final position within the pile.

Referring to FIG. 6, the umbilical, grout and packer hoses 43 are held to the drill string with clamps 44 and lowered with the refrigeration unit. When the refrigeration unit reaches the pile 2, it is inserted into the pile and lowered to the proper level. A quick disconnect 45 is inserted in the drill string so that the final position of the quick disconnect will be slightly above the top of the pile.

When the unit is lowered to the correct elevation, brine solution is pumped down the drill string. Since the density of the brine is greater than that of the seawater, the brine displaces seawater in the lower portion of the pile. Packers 25 are then set and the annulus between the vessel and the pile is pumped with grout 26. The wall of the vessel is precoated with a bond-breaking agent so that the vessel may be broken free of the grout should retrieval be necessary.

After the grout has set, the drill string is broken with the quick disconnect. The drill string, grout and packer hoses are then retrieved.

Figure 7:
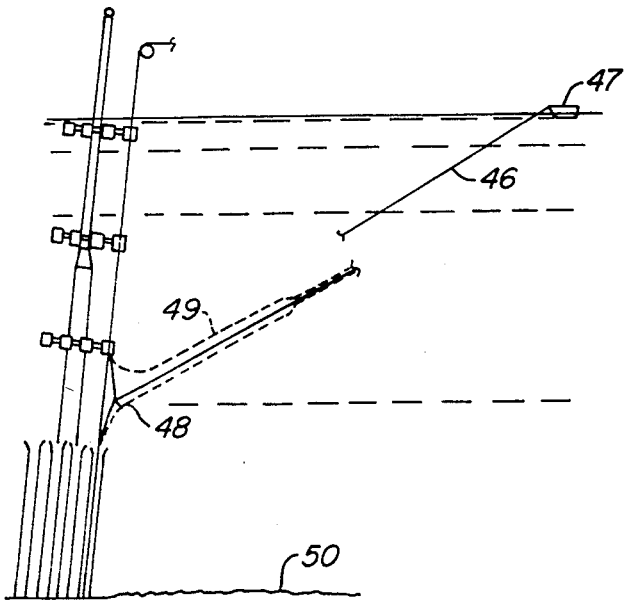
FIG. 7 shows a cross section of the umbilical as it is pulled by a work boat.

Referring to FIG. 7, a wire rope 46 from a work boat 47 is attached to a sliding thimble 48 located on the umbilical 48. The wire rope is used to pull the umbilical and preinstalled messenger line 49 out of the pile and lay it on the ocean floor 50.

Figure 8:
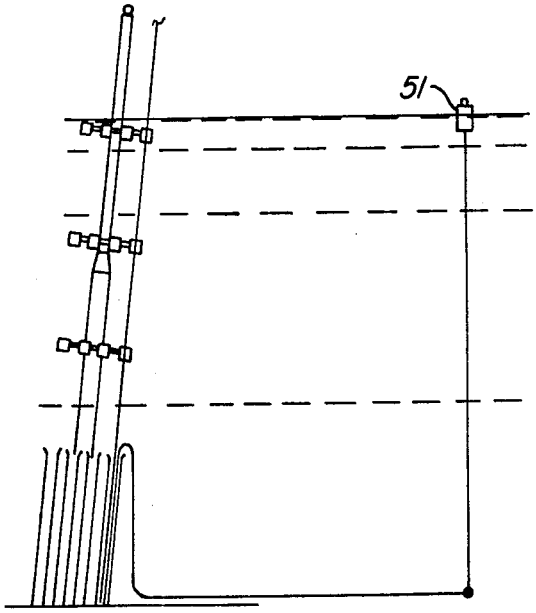
FIG. 8 shows a cross section of the umbilical tied to a marker buoy.

Referring to FIG. 8, the messenger line is pulled on deck of a work boat and attached to a marker buoy 51.

Referring back to FIG. 1, caisson 8 is lowered along the jacket leg 9 and secured to the pile guides 10. A second messenger line is lowered through the caisson, passed to the work boat, and the umbilical is pulled through the caisson. This procedure is followed for each of the piles on the platform. Power and instrumentation are then connected to the umbilicals and the system is placed in operation.

While certain specific embodiments of the invention have been described in detail, the invention is not to be limited to these embodiments, but rather by the scope of the appended claims.

What is claimed is:

1. Apparatus for increasing downward and pull-out load capacity of a tubular pile comprising:

a plug located within a tubular pile, said plug located generally near the bottom of said pile;

a refrigeration unit contained within said tubular pile, above said plug, such that said refrigeration unit defines the top of a generally cylindrical reservoir, the bottom of which is defined by said plug and the sides of whch are defined by said pile;

a cooling fluid filling said reservoir;

means for transferring heat from said cooling fluid to said refrigeration unit further comprising:

(a) an evaporation tank extending into said cooling fluid from said refrigeration unit; and (b) an evaporator extending into said cooling fluid and tubularly connected to said evaporation tank whereby said cooling fluid is circulated by natural convection; and means for transferring heat away from said refrigeration unit into seawater contained within the pile above the refrigeration unit further comprising:

(a) a condenser extending into said seawater from said refrigeration unit whereby seawater is circulated in said pile by natural convection.

2. The apparatus as recited in claim 1 wherein:

said refrigeration unit is a compression/expansion refrigerator capable of cooling said cooling fluid below the freezing temperature of the surrounding soil, said compressor/expansion refrigerator containing a compressor.

3. Apparatus as recited in claim 1 further comprising:

a power line connecting said refrigeration unit to a power source on an offshore platform, and instrument lines connecting said refrigeration unit to instrumentation on said platform.

4. The apparatus as recited in claim 2 further comprising a compressor cooling means, said compressor cooling means extends into said seawater.

5. The apparatus as recited in claim 4 wherein said refrigeration unit is insulated whereby the heat transfer from said seawater to said cooling fluid is minimized.

6. The apparatus as recited in claim 5 wherein said refrigeration unit is tapered, and said refrigeration unit is grouted to the inside of the tubular pile.

7. The apparatus as recited in claim 6 further comprising:

a top tubular frame extending from the top of said refrigeration unit;

a bottom frame extending from the bottom of said refrigeration unit whereby said condenser, cooler, and evaporator are protected by said bottom and top frames when the unit is lowered into the pile and whereby said top tubular frame can be used to lower said refrigeration unit into the pile.

8. The apparatus as recited in claim 7 further comprising a drill string connecting means connected to the top of said top tubular frame whereby a drill string can be used to lower said refrigeration unit into the pile.

9. The apparatus as recited in claim 8 wherein said cooling fluid is calcium chloride.

10. Apparatus as recited in claim 2 wherein said refrigeration unit is a set of three refrigeration units.

* * * * *